US009267190B2

(12) United States Patent
Kim et al.

(10) Patent No.: US 9,267,190 B2
(45) Date of Patent: Feb. 23, 2016

(54) PRODUCTION METHOD AND PRODUCTION DEVICE FOR A COMPOSITE METAL POWDER USING THE GAS SPRAYING METHOD

(75) Inventors: Yong-Jin Kim, Gyeongsangnam-do (KR); Sangsun Yang, Gyeongsangnam-do (KR); Tae-Soo Lim, Gyeongsangnam-do (KR)

(73) Assignee: Korea Institute of Machinery and Materials, Daejeon (KR)

( * ) Notice: Subject to any disclaimer, the term of this patent is extended or adjusted under 35 U.S.C. 154(b) by 183 days.

(21) Appl. No.: 13/378,756

(22) PCT Filed: Dec. 16, 2009

(86) PCT No.: PCT/KR2009/007544

§ 371 (c)(1),
(2), (4) Date: Dec. 16, 2011

(87) PCT Pub. No.: WO2011/074720

PCT Pub. Date: Jun. 23, 2011

(65) Prior Publication Data

US 2012/0244034 A1 Sep. 27, 2012

(30) Foreign Application Priority Data

Dec. 15, 2009 (KR) ..... 10-2009-0124690
Dec. 15, 2009 (KR) ..... 10-2009-0124694

(51) Int. Cl.

| | |
|---|---|
| ***B22F 9/04*** | (2006.01) |
| ***C22C 1/10*** | (2006.01) |
| *C22C 21/04* | (2006.01) |
| *B22F 9/08* | (2006.01) |

(52) U.S. Cl.
CPC ..... *C22C 1/1042* (2013.01); *B22F 2009/0816* (2013.01)

(58) Field of Classification Search
USPC ..... 420/548; 75/338
See application file for complete search history.

(56) References Cited

U.S. PATENT DOCUMENTS

| | | | | |
|---|---|---|---|---|
| 2002/0134198 | A1 | 9/2002 | Edlinger | |
| 2005/0156353 | A1 * | 7/2005 | Watts et al. | 264/293 |

FOREIGN PATENT DOCUMENTS

| | | | |
|---|---|---|---|
| JP | 05-247504 | A | 9/1993 |
| JP | 05-247505 | A | 9/1993 |
| JP | 05-331505 | A | 12/1993 |
| JP | 10-219312 | | 8/1998 |

(Continued)

OTHER PUBLICATIONS

Machine translation of JP 05247504, 1993.*

(Continued)

*Primary Examiner* — Rebecca Lee
(74) *Attorney, Agent, or Firm* — Sheridan Ross P.C.

(57) ABSTRACT

Disclosed herein are a method and an apparatus for preparing a metal composite powder by using gas spraying. The method of preparing a metal composite powder by using gas spraying includes introducing a matrix phase in a chamber, including a reinforcing phase in the chamber, melting the introduced matrix phase to form a melt, adding the reinforcing phase in the melt, stirring the melt with the added reinforcing phase to form a melt mixture, atomizing the melt mixture together with a gas to form a metal composite powder containing the reinforcing phase, and collecting the metal composite powder formed.

9 Claims, 20 Drawing Sheets

(56) References Cited

FOREIGN PATENT DOCUMENTS

| | | | |
|---|---|---|---|
| JP | 2004-502037 | A | 1/2004 |
| KR | 10-0446680 | B1 | 9/2004 |
| KR | 10-2010-0113816 | A | 10/2010 |
| KR | 10-2010-0113828 | A | 10/2010 |
| KR | 10-2010-0122150 | A | 11/2010 |

OTHER PUBLICATIONS

International Search Report prepared by the Korean Patent Office on Dec. 13, 2010, for International Application No. PCT/KR2009/007544.

* cited by examiner

MICROGRAPH OF POWDER CROSS-SECTION (a)

| Element | Weight% | Atomic% |
|---|---|---|
| C K | 15.88 | 40.84 |
| Al K | 45.73 | 41.60 |
| Si K | 0.39 | 0.34 |
| Ti K | 34.00 | 17.42 |
| Totals | 100.00 | |

(b)

Ti
Ti
Ti (a)

(b)

(a)

(b)

(a)

(b)

PRODUCTION METHOD AND PRODUCTION DEVICE FOR A COMPOSITE METAL POWDER USING THE GAS SPRAYING METHOD

CROSS REFERENCE TO RELATED APPLICATIONS

This application is a national stage application under 35 U.S.C. 371 of PCT Application No. PCT/KR2009/007544 having an international filing date of Dec. 16 2009 , which designated the United States, which PCT application claimed the benefit of Korean Application No. 10-2009-0124690 2009 filed Dec. 15, 2009 and Korean Application No. 10-2009-0124694 2009 filed Dec. 15, 2009 , the entire disclosure of each of which is incorporated herein by reference.

BACKGROUND OF THE INVENTION

1. Field of the Invention

The present disclosure relates to a production method and production device for a composite metal powder using gas spraying method.

2. Description of the Related Art

In general, a milling method milling solid metals, a wet method through a chemical process such as precipitation, and an spraying method atomizing molten metals by using an atomizing nozzle after melting metals are used as the methods of preparing metal powders.

Among the foregoing methods, the spraying method may be classified as water spraying using a liquid such as water and gas spraying using gas, according to a cooling medium used therein.

A method of preparing metal powders by typical gas spraying generally prepares metal powders by injecting inert gas such as argon or nitrogen at room temperature while allowing molten metals to flow through an atomizing nozzle. An average particle size of the prepared metal powder is about 100 μm.

Metals may be classified as a metal with a low melting point such as zinc (Zn), aluminum (Al), or tin (Sn), a metal with a high melting point such as stainless steel, copper (Cu), iron (Fe), nickel (Ni), or cobalt (Co), and a multi-component alloy, according to a melting point.

Meanwhile, metallic materials classified as various types as described above include reinforcing phases such that characteristics thereof are improved. The metallic materials containing such reinforcing phases are usually prepared through a melt casting method after mainly introducing the reinforcing phases.

However, with respect to the metallic material prepared through the foregoing melt casting method, near net-shape processing of the prepared product is difficult because the reinforcing phases may separate along interfaces and a separate melt mixing process, in which a matrix phase, i.e., a low melting point material, and a reinforcing phase, i.e., a high melting point material, are mixed together, is added.

Also, non-uniform distribution of the reinforcing phase occurs in a metallic material prepared through melt casting including the foregoing mixing process due to the agglomeration of the reinforcing phase when the reinforcing phase and the matrix phase are mixed. Accordingly, there are limitations in that controls of the amount, size, shape and distribution of the reinforcing phase are difficult and control of the size of the metallic material containing the reinforcing phase is also difficult.

SUMMARY OF THE INVENTION

Embodiments of the present invention are directed to provide a method of preparing a metal composite powder by using gas spraying.

Embodiments of the present invention are also directed to provide an apparatus for preparing a metal composite powder by using gas spraying.

According to an aspect of the present invention, there is provided a method of preparing a metal composite powder by using gas spraying including: introducing a matrix phase into a chamber; including a reinforcing phase in the chamber; melting the introduced matrix phase to form a melt; adding the reinforcing phase in the melt; stirring the melt with the added reinforcing phase to form a melt mixture; atomizing the melt mixture together with a gas to form a metal composite powder containing the reinforcing phase; and collecting the metal composite powder formed.

According to another aspect of the present invention, there is provided an apparatus for preparing a metal composite powder by using gas spraying including: an upper chamber including a crucible in which a matrix phase is introduced and melted; an input device included at an upper side of the crucible in the upper chamber and capable of selectively introducing a reinforcing phase into the crucible; a stirring device stirring the reinforcing phase introduced into the crucible through the input device and a melt formed by heating in the crucible; an atomizing nozzle generating a metal composite powder by atomizing a melt mixture formed by stirring the melt and the reinforcing phase through the stirring device together with a gas; and a lower chamber which is a collecting space of the metal composite powder generated by the atomizing nozzle.

According to another aspect of the present invention, there is provided a method of preparing a metal composite powder by using gas spraying including: preparing a melt by adding and stirring a metal ingot, an alloy ingot, or an aluminum-reinforcing phase powder after melting an aluminum ingot or an aluminum-silicon (Al—Si) based alloy containing a reinforcing phase by heating, or preparing a melt by heating and stirring an aluminum parent material charged with an aluminum-reinforcing phase powder at the bottom thereof after the aluminum-reinforcing phase powder is subjected to Al-foiling (operation 1); and atomizing the melt prepared in operation 1 together with a gas to prepare a metal composite powder (operation 2).

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Features and advantages of the present invention will be more clearly understood by the following detailed description of the present preferred embodiments by reference to the accompanying drawings. It is first noted that terms or words used herein should be construed as meanings or concepts corresponding with the technical spirit of the present invention, based on the principle that the inventor can appropriately define the concepts of the terms to best describe his own invention. Also, it should be understood that detailed descriptions of well-known functions and structures related to the present invention will be omitted so as not to unnecessarily obscure the important point of the present invention.

Hereinafter, specific embodiments of the present invention will be described in detail with reference to the accompanying drawings.

Figure 1:
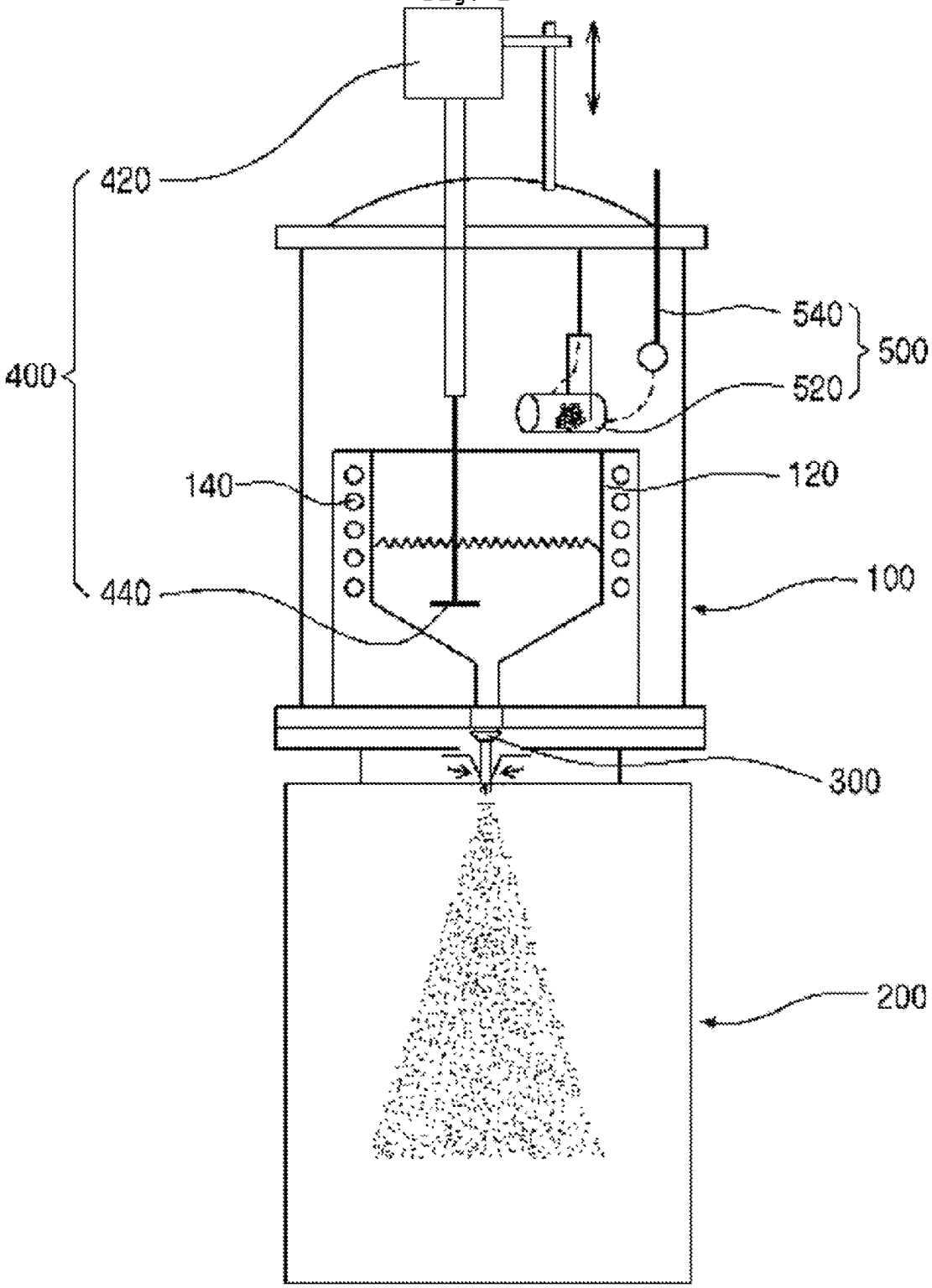
FIG. 1 is a schematic view illustrating an apparatus for preparing a metal composite powder by using gas spraying according to the present invention.

FIG. 1 schematically illustrates a structure of an apparatus for preparing a metal composite powder by using gas spraying according to an embodiment of the present invention.

As shown in FIG. 1, the apparatus for preparing a metal composite powder by using gas spraying according to an embodiment of the present invention is configured to include a matrix phase (a reference numeral 600 in FIG. 3) and a reinforcing phase (a reference numeral 700 in FIG. 3) of a metal composite powder to be prepared in an upper chamber 100.

In particular, a crucible 120 and a heater 140 for melting the matrix phase 600 are included in the upper chamber 100 and an input device 500 accommodating the reinforcing phase 700 is included at an upper side of the crucible 120.

The crucible 120 has an upper opening and a shape which gradually becomes narrower as it extends downward, and an atomizing nozzle 300, which will be described in detail later, is connected to the bottom of the crucible.

A heater for heating the crucible 120 is installed at the outside of the crucible 120 to heat the matrix phase 600 accommodated therein together with the crucible 120.

The input device 500 includes an accommodating part 520 and a controlling part 540 and is approximately formed as a cylindrical shape, wherein the accommodation part 520 accommodating the reinforcing phase 700 has a rotation axis at a position toward one end away from the center of a body and is rotatable around the rotation axis.

The controlling part 540, which tilts the accommodating part 520 by user interaction to introduce the reinforcing phase 700 accommodated in the accommodating part 520 into the crucible 120, is connected to one side of the body of the accommodating part 520.

That is, one end of the controlling part 540 is connected to the accommodating part 520 and the other end is exposed to the outside of the chamber 100. When a user grabs and pulls the exposed other end, the accommodating part 520 ascends along a pulling direction of the user around the rotation axis and the reinforcing phase 700 accommodated in the accommodation part 520 will be put into the crucible 120 along the slope.

Also, it is possible to configure the controlling part 540 in such a manner that a motor and a control switch are included and the accommodating part 520 is tilted toward one direction by the operation of the motor when the user manipulates the control switch.

Meanwhile, the matrix phase 600 is accommodated in the crucible 120 and is melted through heating by the heater 140. A portion of a stirring device 400 is accommodated in the crucible 120 in order to stir the reinforcing phase 700 introduced into the melt thus formed.

In particular, the stirring device 400 includes a stirring motor 420, which is included in one side of the chamber 100 to generate a torque, and an impeller 440, which is connected to a rotation axis of the stirring motor 420, is included in the crucible, and rotates to stir the melt, i.e., the matrix phase 600 and the reinforcing phase 700 in a molten state.

Although details are not illustrated in FIG. 1, a height of the stirring motor 420 may be adjusted by using a cylinder or a separate motor and thus, a position of the impeller 440 is adjustable in the crucible 120 such that the reinforcing phase 700 introduced into the melt may be stirred smoothly with the melt.

Meanwhile, metals (Al, Cu, Fe, etc.) and alloys (AlSi, FeNi, etc.) having relatively low melting points are used for the matrix phase 600, and one or more of ceramics (SiC, TiC, $Al_2O_3$, $SiO_2$, etc.) and intermetallic compounds ($Al_3Zr$, etc.) or organic and inorganic materials having melting points relatively higher than that of the matrix phase 600 are used for the reinforcing phase 700.

The matrix phase 600 has a size range of 10 μm to 1000 μm, and the reinforcing phase 700 has a size relatively smaller than that of the matrix phase 600 and may have a size range of 1 nm to 100 μm.

The reason is that the role of the reinforcing phase 700 for improving the characteristics of the matrix phase 600 is not performed when the reinforcing phase 700 has a size larger than that of the matrix phase 600.

A volume fraction of the reinforcing phase 700 introduced is within a range of 0.1 vol % to 70 vol % with respect to the molten matrix metal. The reason is that gas spraying is not facilitated due to high viscosity when the volume fraction of the reinforcing phase 700 is 70% or more.

Meanwhile, the atomizing nozzle 300 is connected to the bottom of the crucible 120, and a melt mixture of the reinforcing phase 700 having the foregoing size and volume fraction ranges and the melt may be atomized into the inside of a lower chamber 200 together with high pressure gas. Detailed description will not be provided because the foregoing nozzle structure is an already known technique.

The melt mixture atomized by the atomizing nozzle 300 is transformed to a powder form while being injected together with high pressure gas and a metal composite powder thus transformed is collected in the lower chamber 200.

That is, as shown in FIG. 1, the lower chamber 200 supports the upper chamber 100 thereunder and is connected to the atomizing nozzle 300. Also, the lower chamber 200 collects and stores the metal composite powder transformed to a powder form by being atomized together with gas at an end of the atomizing nozzle 300, and although not shown in FIG. 1, a cyclone is further included under the lower chamber 200 for this purpose.

Hereinafter, a method of preparing a metal composite powder through gas spraying by using the foregoing metal composite powder preparation apparatus is described in detail with reference to the attached drawings.

Figure 2:
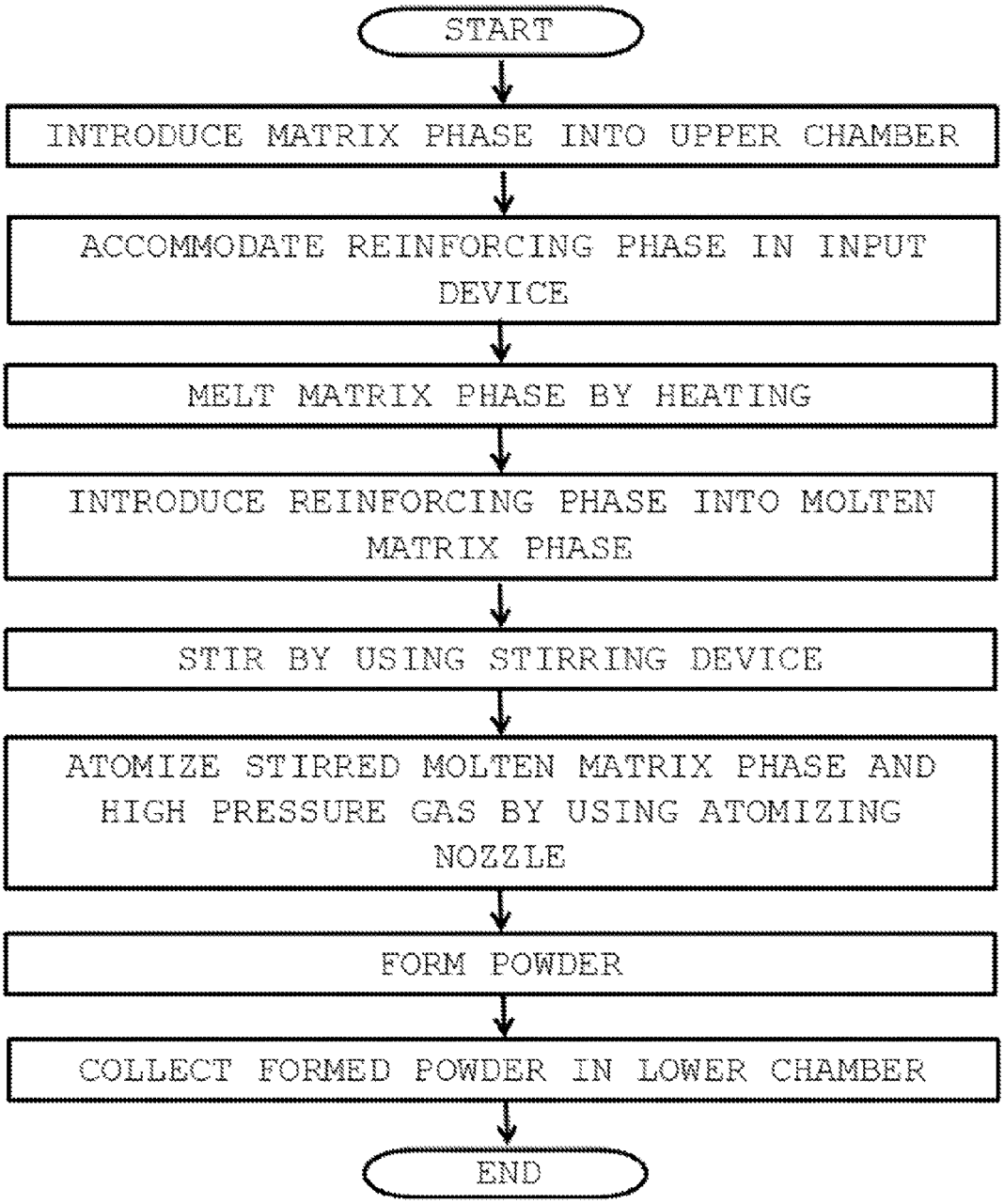
FIG. 2 is a flowchart illustrating a method of preparing a metal composite powder by using gas spraying according to the present invention.

FIG. 2 is a flowchart illustrating a method of preparing a metal composite powder by using gas spraying according to the present invention.

As shown in FIG. 2, introducing a matrix phase (a reference numeral 600 in FIG. 3) in the upper chamber 100 is first performed in the method of preparing a metal composite powder by using gas spraying according to the present invention.

That is, a crucible 120 accommodating the matrix phase 600 is included in the upper chamber 100 and the matrix phase 600 is accommodated in the crucible 120.

Accommodating the reinforcing phase 700 in an input device 500 included in the upper chamber 100 is performed separately from the introducing of the matrix phase 600.

That is, the introducing of the matrix phase 600 in the crucible 120 and the accommodating of the reinforcing phase 700 in an accommodating part 520, i.e., a component of the input device 500, are performed separately and thus, may be performed regardless of the order. However, since the reinforcing phase 700 is introduced to reinforce mechanical properties of the matrix phase 600, the reinforcing phase 700 may be accommodated after accommodating the matrix phase 600 in consideration of the properties which will be reinforced.

Meanwhile, when the accommodations of the matrix phase 600 and the reinforcing phase 700 in the upper chamber 100 are completed, melting the matrix phase 600 accommodated in the crucible 120 to form a melt is performed.

In the forming of the melt, the matrix phase 600 is transformed to a melt having a temperature of about 900° C. by induction melting in the crucible 120 included in the upper chamber 100.

Introducing the reinforcing phase 700 in the melt, which is formed by melting the matrix phase 600, is performed.

At this time, the reinforcing phase 700 is included in an accommodating part 520 which is connected to a controlling part 540 in order for a user to control from the outside as described above. Therefore, when the user confirms the state of the matrix phase 600 and that the matrix phase 600 was transformed to a melt, it is possible to introduce the reinforcing phase 700 into the melt by using the controlling part 540.

The foregoing reinforcing phase 700 is a material having a melting point higher than that of the matrix phase 600 as described above and maintains it characteristics in a state of being introduced into the melted matrix phase 600.

When the reinforcing phase 700 is introduced into the melt, i.e., the melted matrix phase 600, a stirring motor 420, which is a component of the stirring device 400, rotates so as to rotate an impeller 440 connected thereto at high speed. Thus, the reinforcing phase 700 is uniformly dispersed in the melt by the impeller 440 rotating at high speed and a melt mixture is obtained.

Meanwhile, when the melt mixture is formed, forming a metal composite powder is performed by atomizing the melt mixture with high pressure gas using an atomizing nozzle 300.

The metal composite powder thus formed is collected and stored in the lower chamber 200 in a state of containing the reinforcing phase 700 in the matrix phase 600.

Hereinafter, the metal composite powder thus prepared is described in more detail with reference to the attached drawings.

Figure 3:
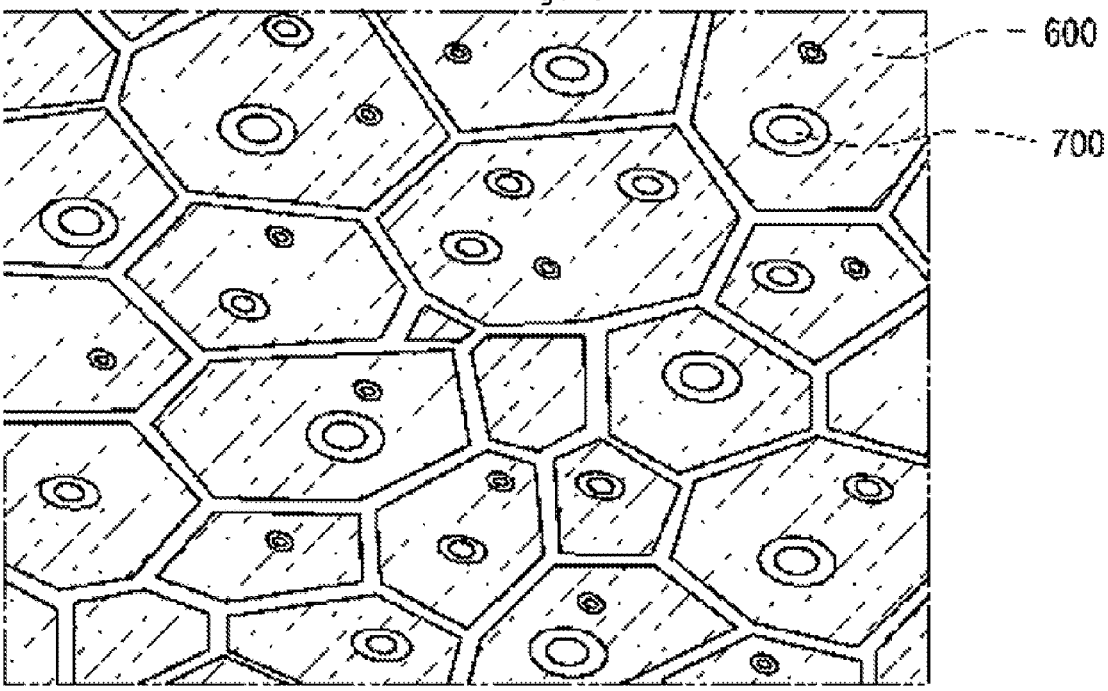
FIG. 3 is a cross-sectional view illustrating a crystal structure of a metal composite powder prepared according to a preparation method of the present invention.

FIG. 3 is a cross-sectional view schematically illustrating a crystalline structure of a metal composite powder prepared according to the present invention.

As shown in FIG. 3, the metal composite powder prepared by a preparation method using gas spraying according to the present invention contains the reinforcing phase 700 in the matrix phase 600 and an interface is formed between the reinforcing phase 700 and the matrix phase 600. Therefore, that the reinforcing phase 700 is non-uniformly distributed at one side of the matrix phase 600 by agglomeration is prevented.

Hereinafter, the present invention is described in detail according to embodiments.

Figure 4:
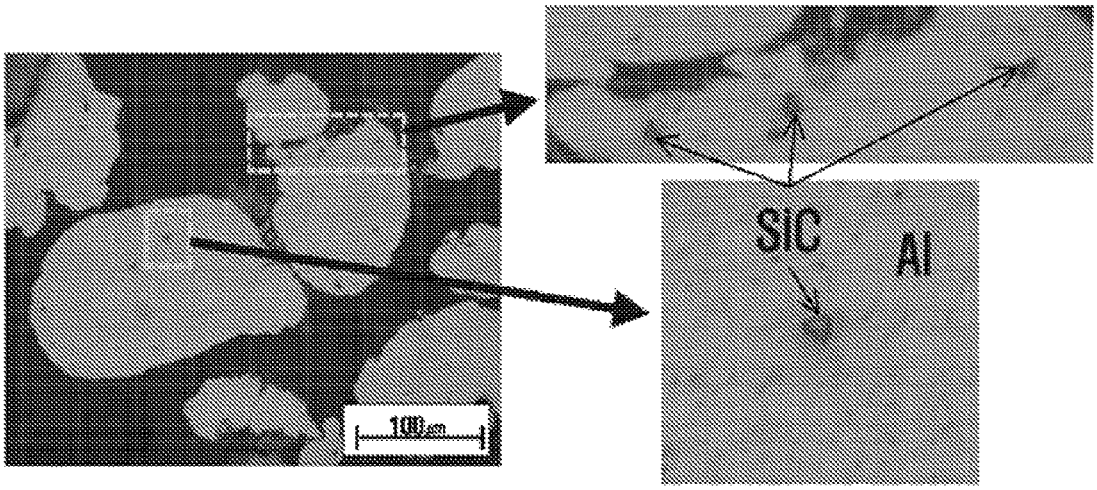
FIG. 4 is micrographs showing a microstructure of an aluminum (Al) composite powder containing silicon carbide (SiC) prepared by a preparation method of the present invention and an enlarged portion of the microstructure.
Figure 5:
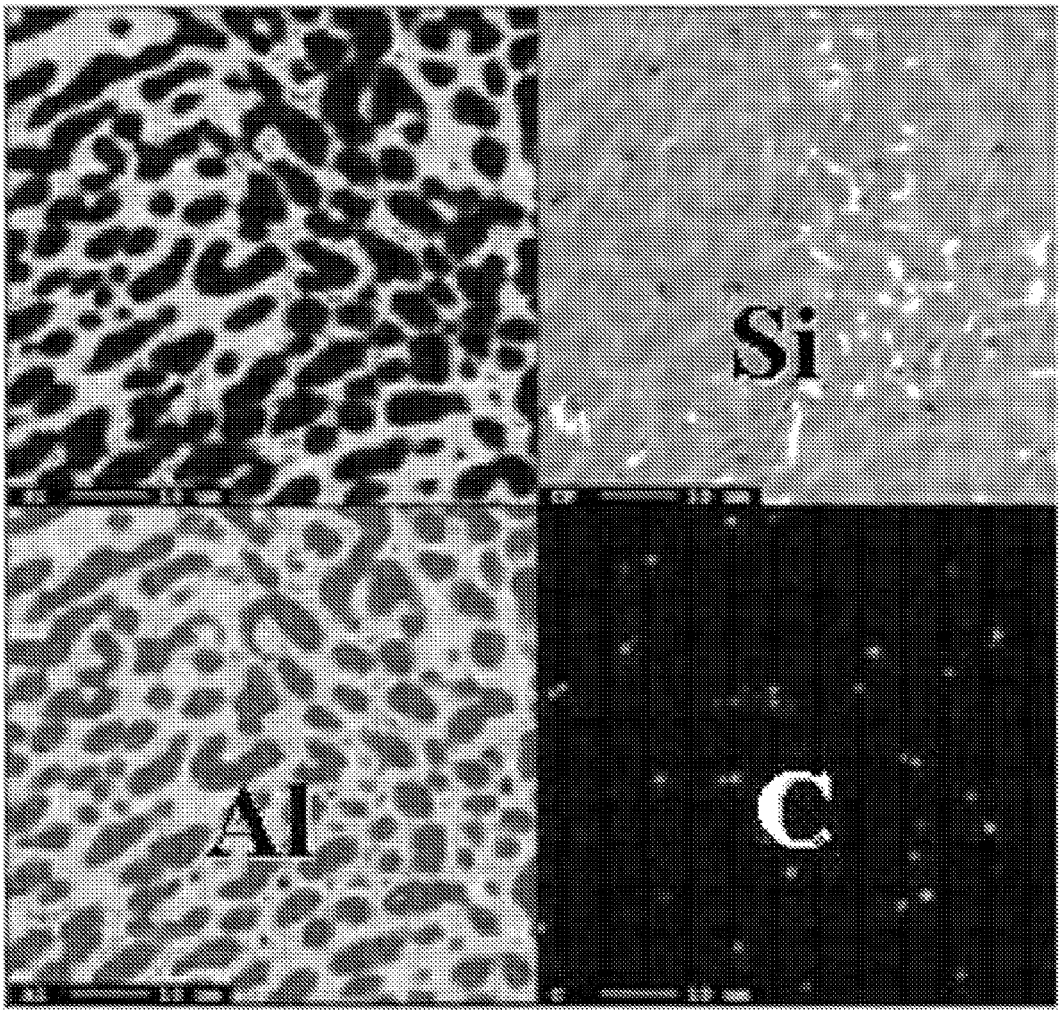
FIG. 5 shows the results of electron probe micro analysis (EPMA) performed on an aluminum (Al) composite powder containing silicon carbide (SiC) prepared by a preparation method of the present invention.
Figure 6:
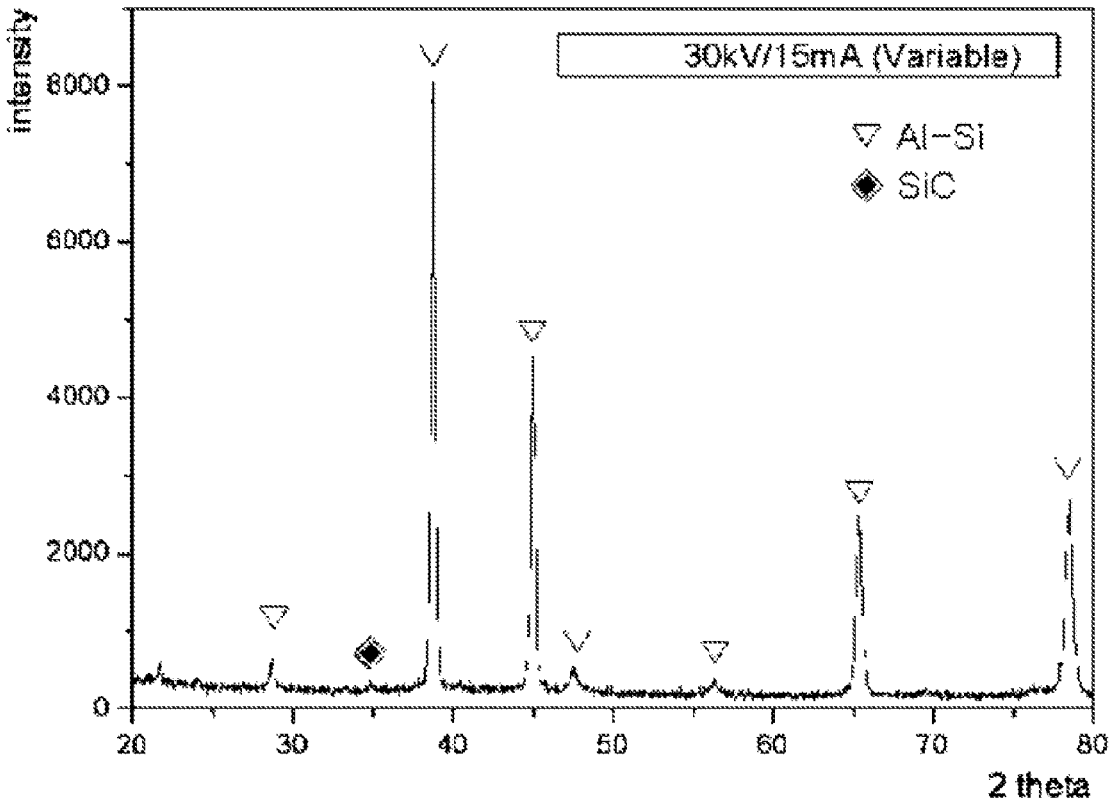
FIG. 6 is a graph showing the results of X-ray diffraction analysis performed on an aluminum (Al) composite powder containing silicon carbide (SiC) prepared by a preparation method of the present invention.

FIG. 4 is micrographs showing a microstructure of an aluminum (Al) composite powder containing silicon carbide (SiC) prepared by a preparation method of the present invention, FIG. 5 shows the results of electron probe micro analysis (EPMA) performed on an aluminum composite powder containing silicon carbide prepared by a preparation method of the present invention, and FIG. 6 is a graph showing the results of X-ray diffraction analysis performed on an aluminum composite powder containing silicon carbide prepared by a preparation method of the present invention.

The metal composite powders shown in the foregoing micrographs are formed by the method of forming a metal composite powder using gas spraying according to the present invention and by a metal composite powder preparation apparatus. The metal composite powders are aluminum composite powders containing silicon carbide which is one kind of ceramics.

The Al composite powder containing silicon carbide is melted in a crucible 120 in the upper chamber 100 by induction melting to become an aluminum melt having a temperature of about 900° C. and about 2 vol % of silicon carbide stored in the accommodating part 520 is directly introduced into the aluminum melt.

The aluminum melt with the introduced silicon carbide is stirred by an impeller rotating at about 500 rpm while the stirring device 400 is moved up and down, and thus, a melt mixture is formed.

The melt mixture of silicon carbide and aluminum thus formed is transferred through an atomizing nozzle 300 having a diameter of 2 mm and a mixed gas (nitrogen:oxygen=8:2) having a pressure of about 20 bars together with the melt mixture is injected to the end of the atomizing nozzle 300. As a result, an Al composite powder containing SiC having a size of about 150 μm is formed and the Al composite powder containing SiC is collected and stored in the lower chamber 200.

According to the results of micrographs, electron microscopic analysis, and X-ray diffraction analysis of the Al composite powder containing SiC formed through the foregoing processes, it is confirmed that the SiC reinforcing phase 700 is contained in the Al matrix phase 600.

Also, the present invention provides a method of preparing a metal composite powder by using gas spraying including: preparing a melt by adding and stirring a metal ingot, an alloy ingot, or an aluminum-reinforcing phase powder after melting an aluminum ingot or an Al—Si based alloy containing a reinforcing phase by heating, or preparing a melt by heating and stirring an aluminum parent material charged with an aluminum-reinforcing phase powder at the bottom thereof after the aluminum-reinforcing phase powder is subjected to Al-foiling (operation 1); and atomizing the melt prepared in operation 1 together with gas to prepare a metal composite powder (operation 2).

Hereinafter, the method of preparing a metal composite powder by using gas spraying according to the present invention is described in detail operation by operation.

Figure 8:
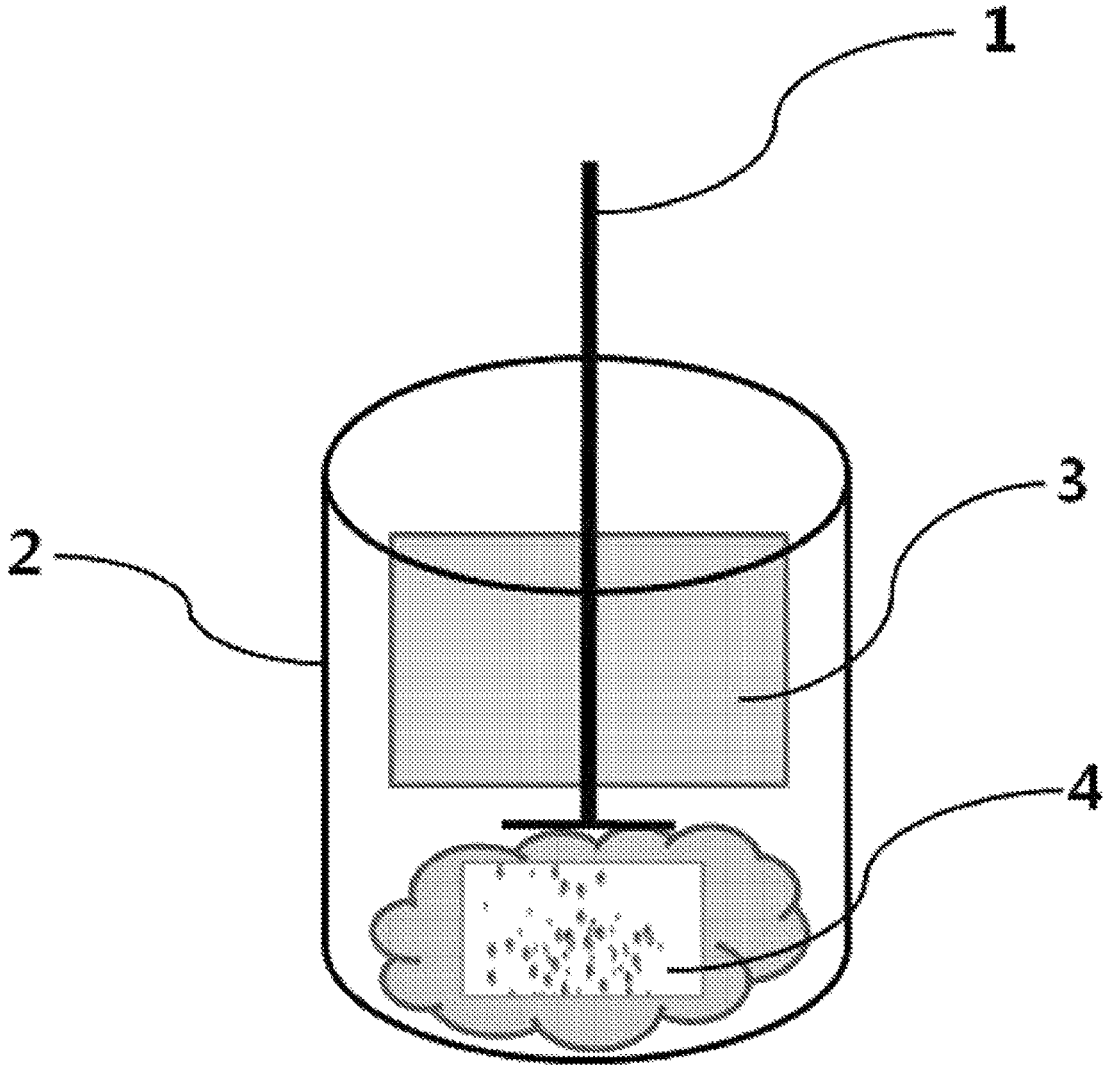
FIG. 8 is a schematic view illustrating a method of introducing an aluminum-reinforcing phase powder according to the present invention.

In the method of preparing a metal composite powder by using gas spraying according to the present invention, operation 1 is preparing a melt by adding and stirring a metal ingot, an alloy ingot, or an aluminum-reinforcing phase powder after melting an aluminum ingot or an Al—Si based alloy containing a reinforcing phase by heating, or preparing a melt by heating and stirring an aluminum parent material charged with an aluminum-reinforcing phase powder at the bottom thereof after the aluminum-reinforcing phase powder is subjected to Al-foiling (see FIG. 8).

At this time, SiC, AlN, or TiC may be used as the reinforcing phase in operation 1.

Also, aluminum (Al), tin (Sn), or copper (Cu) may be used as the metal ingot in operation 1 and an aluminum-silicon (Al—Si) alloy, an aluminum-copper (Al—Cu) alloy, or an aluminum-iron (Al—Fe) alloy may be used as the alloy ingot in operation 1.

Figure 7:
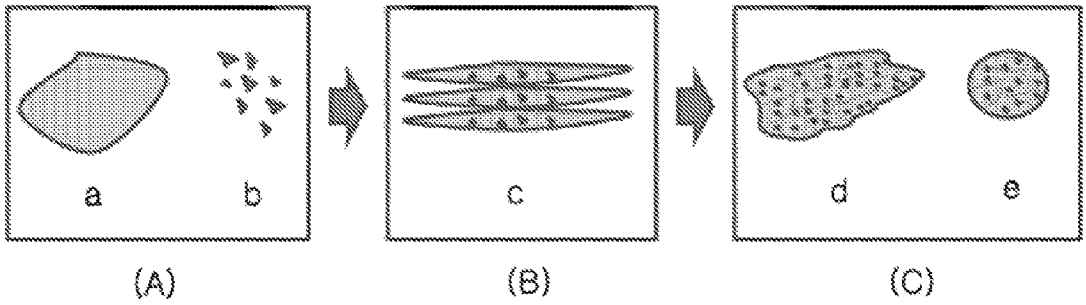
FIG. 7 is a flowchart of mechanical milling according to the present invention ((A): raw materials (a: Al, b: a reinforcing phase), (B): mechanical activation (c: uniform distribution of the reinforcing phase in Al due to continuous cold pressure welding and breaking), (C): final materials ((d) plate-shaped and (e) spherical Al-reinforcing phase powder particles in which the reinforcing phase is uniformly distributed in Al)

Further, aluminum and reinforcing phase powders are mixed together and then the aluminum-reinforcing phase powder in operation 1 may be prepared by mechanical milling. The mechanical milling is performed by using a horizontal mill which is a low-energy ball mill and stainless balls. The milling is performed for about 30 minutes in order to prepare a plate-shaped powder and the milling may be performed for about 5 hours in order to prepare a spherical powder. Milling time and rpm may be adjusted according to a low-energy milling method and a high-energy milling method. The reinforcing phase will be uniformly distributed in the aluminum matrix by the mechanical milling (see FIG. 7).

Also, the aluminum-reinforcing phase powder is prepared in a plate or spherical shape having a size range of 10 μm to 5000 μm and a particle size of the reinforcing phase existing in the aluminum-reinforcing phase powder is in a range of 0.001 μm to 50 μm.

The aluminum-reinforcing phase powder in operation 1 may be added at a temperature in which a crystal structure generated in the aluminum-reinforcing phase powder is maintained.

The melt in operation 1 may have the reinforcing phase in a range of 0.1 vol % to 70 vol %. When the reinforcing phase is less than 0.1 vol %, tensile strength and wear resistance are not improved and when the reinforcing phase is more than 70 vol %, a metal composite powder may not be prepared by gas spraying because viscosity of the melt increases.

Also, operation 1 may further include increasing melt temperature to a temperature range of 700° C. to 800° C. within 5 minutes to 30 minutes. The viscosity of the melt is lowered by performing the foregoing process such that gas spraying is facilitated, and segregation and decomposition of the reinforcing phase may be prevented.

Next, in the method of preparing a metal composite powder by using gas spraying according to the present invention, operation 2 is preparing a metal composite powder by atomizing the melt prepared in operation 1 together with gas.

At this time, a mixed gas, in which a volume fraction ratio between nitrogen and oxygen is in a range of 7:3 to 9:1, may be used as the gas in operation 2.

Also, the spraying in operation 2 may be performed in a pressure range of 5 bars to 100 bars. When the spraying is performed at a pressure less than 5 bars, the size of the prepared metal composite powder increases and the particle size distribution will be broadened. When the pressure is more than 100 bars, powder preparation efficiency decreases because the metal composite powder is prepared in a flake shape.

Further, the present invention provides a metal composite powder prepared by atomizing a melt, which is prepared by adding and stirring a metal ingot, an alloy ingot, or an aluminum-reinforcing phase powder after an aluminum ingot or an Al—Si based alloy containing a reinforcing phase is melted by heating, together with a gas.

Therefore, the method of preparing a metal composite powder by using gas spraying according to the present invention may mass produce the metal composite powder having a reinforcing phase distributed as an intra-granular structure in a metal matrix phase by using gas spraying and improves tensile strength and wear resistance of a metal by means of uniform distribution of the reinforcing phase. Therefore, the method may be used usefully for the preparation of metal composite powders.

Also, the present invention provides an apparatus for preparing a metal composite powder by using gas spraying including: an upper chamber including a crucible in which an aluminum ingot or an Al—Si based alloy containing a reinforcing phase is introduced and melted; an input device included at an upper side of the crucible in the upper chamber and capable of selectively introducing a metal ingot, an alloy ingot, or an aluminum-reinforcing phase powder into the crucible; a stirring device stirring the metal ingot, the alloy ingot, or the aluminum-reinforcing phase powder introduced into the crucible through the input device and a melt formed by heating in the crucible; an atomizing nozzle generating a metal composite powder by atomizing a melt mixture formed by stirring the metal ingot, the alloy ingot, or the Al-reinforcing phase powder and the melt through the stirring device together with gas; and a lower chamber which is a collecting space of the metal composite powder generated by the atomizing nozzle.

Further, the stirring device of the metal composite powder preparation apparatus using gas spraying according to the present invention may include a stirring motor included at the outside of the upper chamber and an impeller connected to the stirring motor and rotating in the crucible, and the input device may include an accommodating part accommodating the metal ingot, the alloy ingot, or the aluminum-reinforcing phase powder and a controlling part that activates the accommodating part to introduce the metal ingot, the alloy ingot, or the aluminum-reinforcing phase powder into the crucible.

Hereinafter, the present invention is described in detail according to the following examples. However, the following examples are only exemplary of the present invention, and the contents of the present invention are not limited to the following examples.

EXAMPLE 1

1 kg of an Al—Si—SiC based alloy ingot (an ingot in which 20 vol % of SiC was contained in an Al matrix, and 8 wt % to 9 wt % of Si, a maximum 0.2 wt % of Fe, a maximum 0.2 wt % of Cu, 0.45 wt % to 0.65 wt % of Mg, and a maximum 0.2 wt % of Ti were contained, purchased from MC-21 Inc.) was charged into a crucible in an upper chamber of a gas atomizer, and then a melt was prepared and stirred by melting a parent material through induction heating to about 580° C. Thereafter, the melt temperature was rapidly increased to 750° C. within 10 minutes. A metal composite powder was prepared by injecting a mixed gas having a volume fraction ratio between nitrogen and oxygen of 8:2 at a pressure of 20 bars into a melt mixture while the melt mixture was atomized through a nozzle having a diameter of 3 mm.

EXAMPLE 2

A metal composite powder was prepared in the same manner as Example 1 except that an Al—Si—SiC based alloy ingot (an ingot in which 20 vol % of SiC was contained in an Al matrix, and 8 wt % to 9 wt % of Si, a maximum 0.2 wt % of Fe, a maximum 0.2 wt % of Cu, 0.45 wt % to 0.65 wt % of Mg, and a maximum 0.2 wt % of Ti were contained, purchased from MC-21 Inc.) and an Al—Si—Cu—Fe—Mg—Mn based alloy ingot (a weight ratio of Al:Si:Cu:Fe:Mg:Mn=69.5:20:3.5:5.5:1.2:0.5) were melted by adding into a melt and stirred.

EXAMPLE 3

A metal composite powder was prepared in the same manner as Example 1 except that 500 g of an Al—Si—SiC based alloy ingot (an ingot in which 20 vol % of SiC was contained in an Al matrix, and 8 wt % to 9 wt % of Si, a maximum 0.2 wt % of Fe, a maximum 0.2 wt % of Cu, 0.45 wt % to 0.65 wt % of Mg, and a maximum 0.2 wt % of Ti were contained, purchased from MC-21 Inc.) was used and melted at 660° C. after adding a pure Al ingot having the same volume for the control of a SiC fraction.

EXAMPLE 4

Aluminum and TiC powder were mixed together, and then mechanical milling was performed by using a horizontal mill which is a low-energy ball mill and stainless balls. The milling was performed for about 30 minutes in order to prepare a plate-shaped powder and the milling was performed for about 5 hours in order to prepare a spherical powder. An Al—TiC powder was prepared by using the mechanical milling, and then an aluminum ingot was melted and the prepared Al—TiC powder was added thereto and stirred. Thereafter, the melt temperature was rapidly increased to 750° C. within 10 minutes. A metal composite powder was prepared by injecting a mixed gas having a volume fraction ratio between nitrogen and oxygen of 8:2 at a pressure of 20 bars into a melt mixture while the melt mixture was atomized through a nozzle having a diameter of 3 mm.

COMPARATIVE EXAMPLE 1

A metal composite powder was prepared in the same manner as Example 1 except that the melt temperature was rapidly increased to 850° C. within 15 minutes.

COMPARATIVE EXAMPLE 2

A metal composite powder was prepared in the same manner as Example 1 except that the melt temperature was rapidly increased to 950° C. within 15 minutes.

COMPARATIVE EXAMPLE 3

An Al—Si—SiC based alloy ingot (an ingot in which 20 vol % of SiC was contained in an Al matrix, and 8 wt % to 9 wt % of Si, a maximum 0.2 wt % of Fe, a maximum 0.2 wt % of Cu, 0.45 wt % to 0.65 wt % of Mg, and a maximum 0.2 wt % of Ti were contained, purchased from MC-21 Inc.) was heated to prepare a melt, and then a sample was prepared after cooling.

Analysis

1. Surface Analysis of Al powder, TiC Powder, and Al—TiC Composite Powder Prepared by Using Mechanical Activation Method A scanning electron microscope (SEM, JEOL, 6500F) was used to analyze surfaces of Al powder, TiC powder, and Al—TiC powder prepared by using a mechanical activation method, and the results thereof are presented in FIG. 9.

Figure 9:
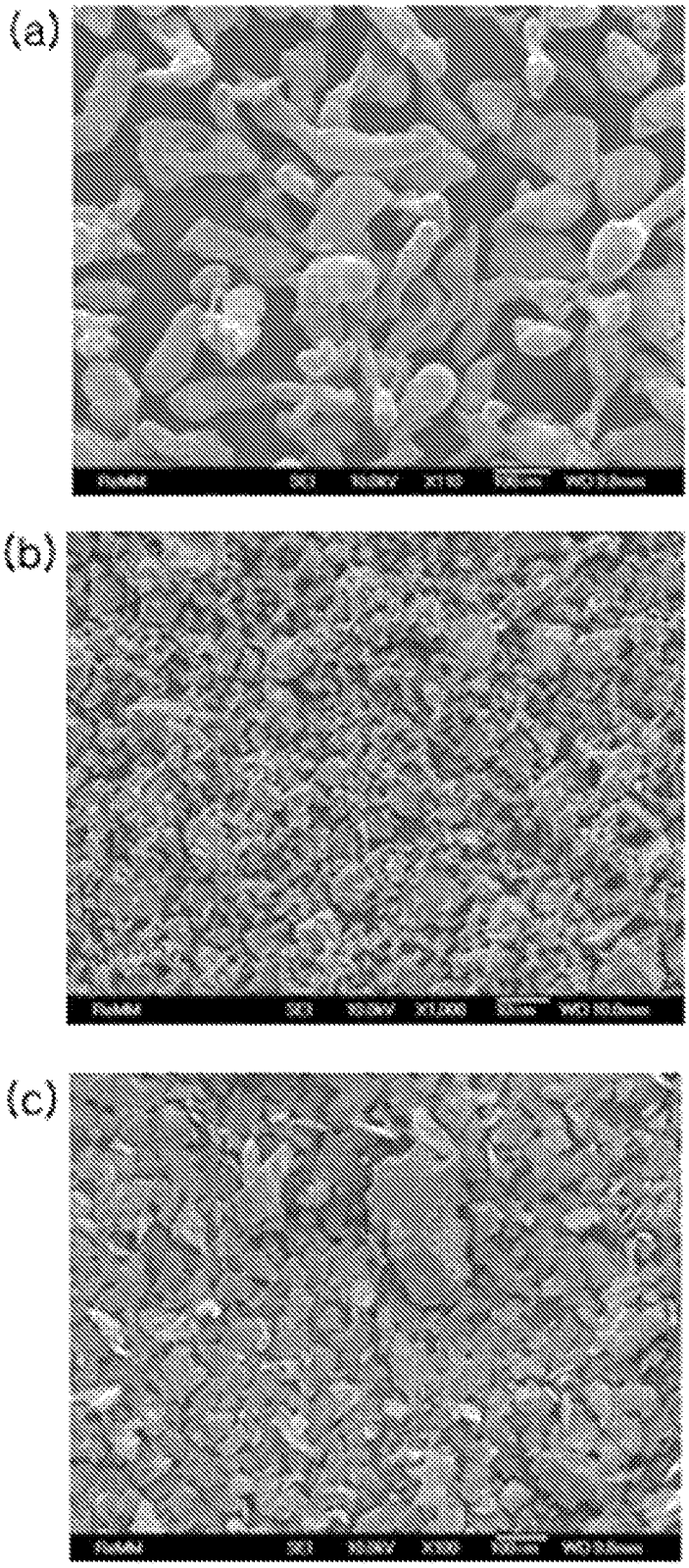
FIG. 9 is scanning electron micrographs of Al powder, TiC powder, and Al—TiC powder prepared by a mechanical activation method according to the present invention ((a): Al, (b): TiC, (c): Al—TiC)

Referring to FIG. 9, FIG. 9(*a*) shows a surface of the aluminum powder, (b) shows a surface of the TiC powder, and (c) shows a surface of the Al—TiC powder prepared by using a mechanical activation method.

2. Al Alloy Ingot Containing 2 wt % of TiC Powder

Figure 10:
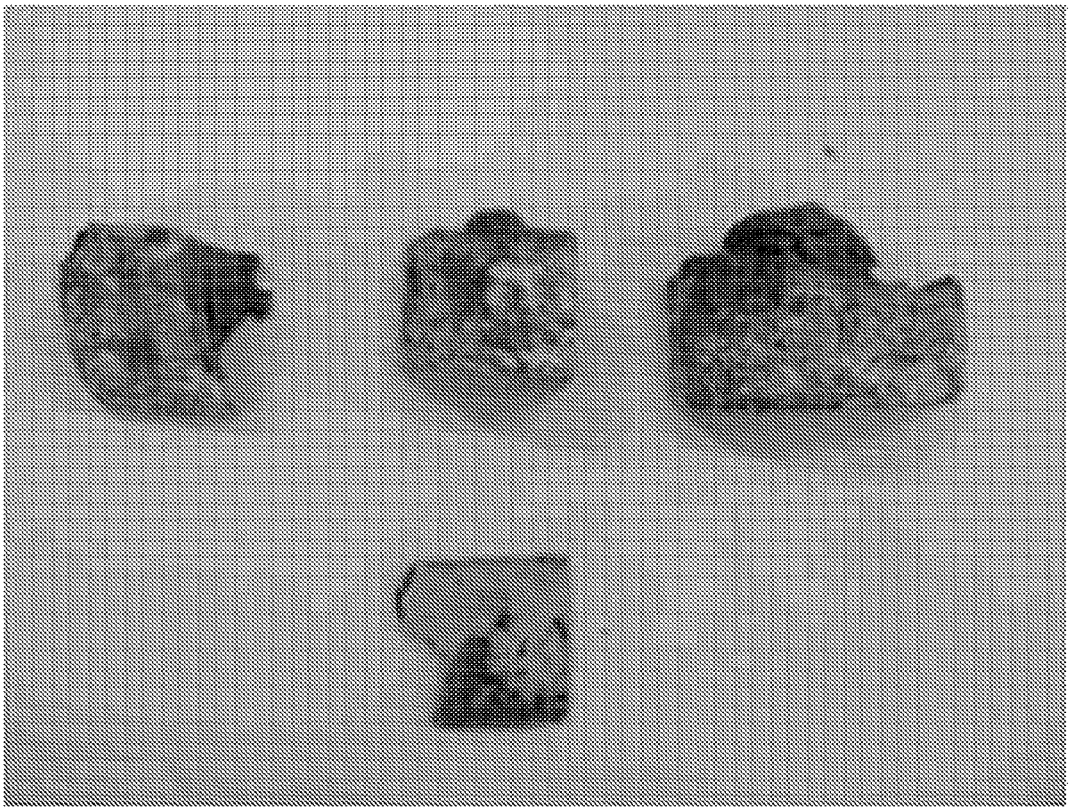
FIG. 10 is a photograph showing Al alloy ingots containing 2 wt % of TiC powder.

An aluminum-reinforcing phase powder was prepared by mechanical milling of aluminum and reinforcing powder, and then a melt is prepared by melting the aluminum-reinforcing phase powder together with an aluminum ingot. An Al alloy ingot containing 2 wt % of TiC powder was prepared by stirring at high speed and solidifying the melt, and photographs were taken therefrom. The Al alloy ingots containing 2 wt % of TiC powder were shown in FIG. 10.

3. Surface and Compositional Analysis of Al Alloy Ingot Containing TiC Powder

An aluminum-reinforcing phase powder was prepared by mechanical milling of aluminum and reinforcing powder, and then a melt is prepared by melting the aluminum-reinforcing phase powder together with an aluminum ingot. An Al—TiC alloy ingot was prepared by stirring at high speed and solidifying the melt. SEM analysis and point analysis of energy dispersive X-ray spectroscopy (EDS) were performed in order to investigate the surface and composition of the prepared Al—TiC alloy ingot and the results thereof are shown in FIG. 11.

Figure 11:
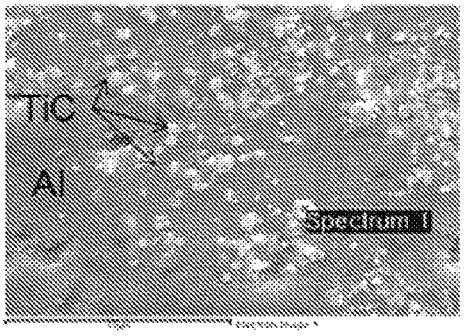
FIG. 11 is (a) a scanning electron micrograph of an Al alloy ingot and (b) a graph showing the results from the point analysis of energy dispersive X-ray spectroscopy (EDS)
Figure 11:
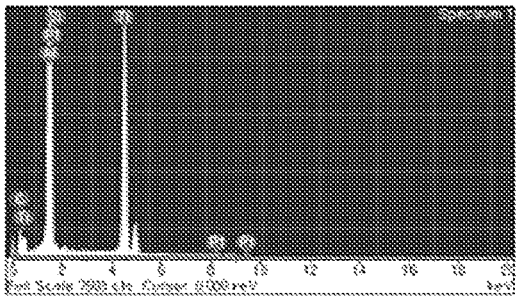

As shown in FIG. 11, it may be understood that TiC particles were intra-granularly distributed in an Al matrix (see FIG. 11(*a*)), and Al, Ti, and C were included as major components (see FIG. 11(*b*)).

4. Compositional Analysis of Al Alloy Ingot Containing TiC Powder

An aluminum-reinforcing phase powder was prepared by mechanical milling of aluminum and reinforcing powder, and then a melt is prepared by melting the aluminum-reinforcing phase powder together with an aluminum ingot. An Al—TiC alloy ingot was prepared by stirring at high speed and solidifying the melt. EDS mapping analysis was performed in order to investigate the composition of the prepared Al—TiC alloy ingot and the results thereof are shown in FIG. 12.

Figure 12:
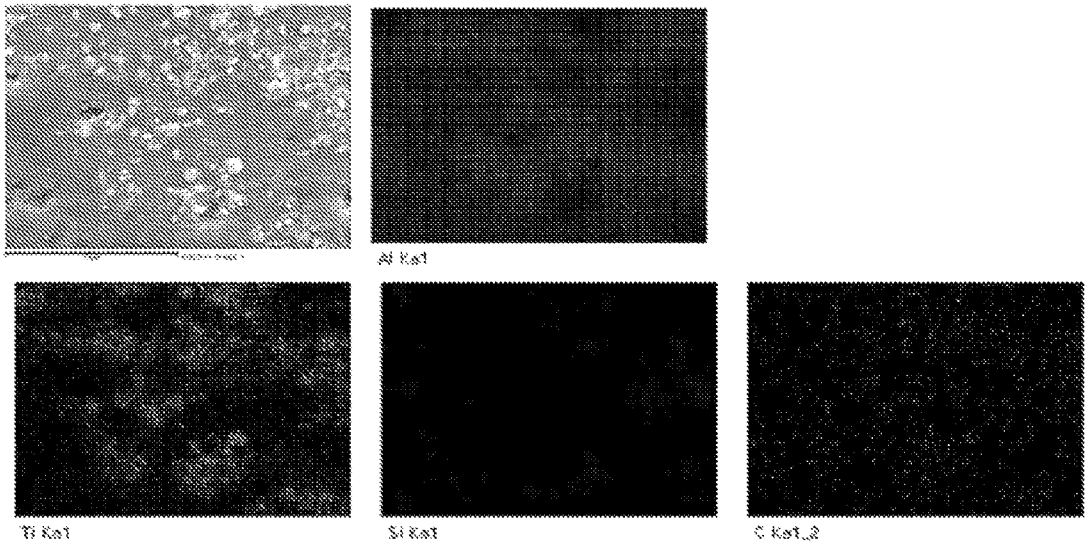
FIG. 12 is photographs showing the results of EDS mapping analysis on an Al alloy ingot.

As shown in FIG. 12, it may be understood that Al, Ti, and C were included as major components and a small amount of Si was also included.

5. Compositional Analysis of Metal Composite Powder Prepared by Using Gas Spraying Field emission scanning electron microscope (SEM-EDS, HITACHI, S-4200) analysis was performed in order to investigate the composition of the metal composite powder according to the present invention and the results thereof are shown in FIG. 13.

Figure 13:
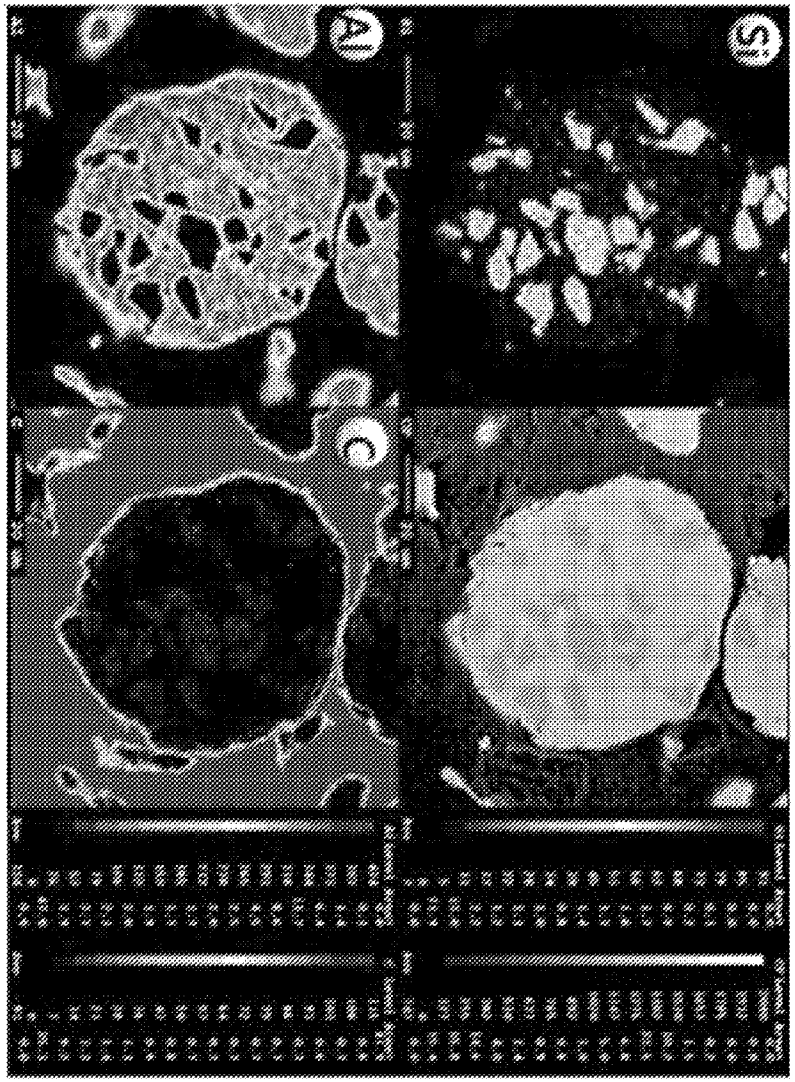
FIG. 13 is the results of field emission scanning electron microscope (SEM) analysis showing components of a metal composite powder according to the present invention.

As shown in FIG. 13, it may be understood that the metal composite powder according to the present invention had an intra-granular structure in which SiC was distributed in an Al matrix.

6. Surface Analysis of Metal Composite Powder According to SiC Fraction

Figure 14:
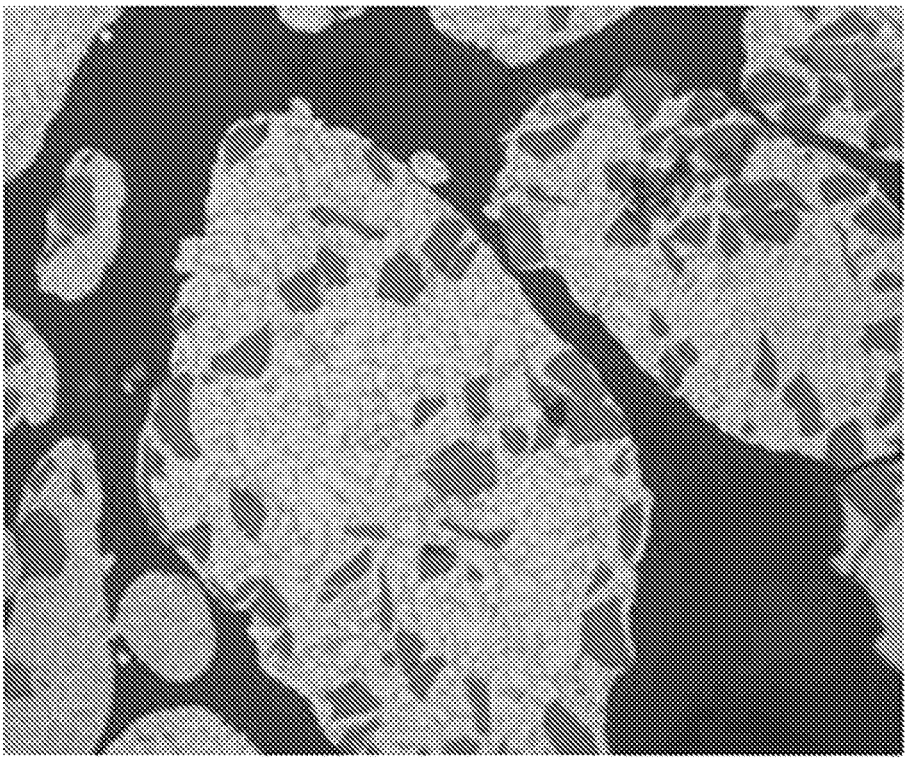
FIG. 14 is optical micrographs showing surfaces of metal composite powders having different SiC fractions in an Al matrix prepared according to the method of the present invention ((a): 20 vol % SiC, (b) 30 vol % SiC)
Figure 14:
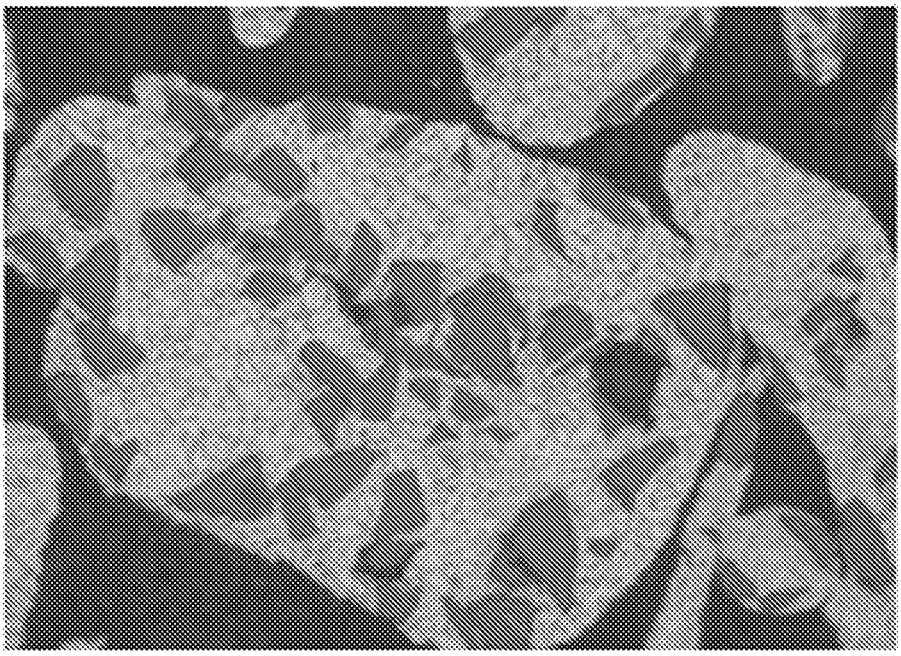

Optical microscope (OM, NIKON, EPIPHOT) analysis was performed in order to investigate the surfaces of the metal composite powders prepared with different SiC fractions in an Al matrix by using the preparation method according to the present invention and the results thereof are shown in FIG. 14.

FIG. 14(*a*) shows a metal composite powder containing 20 vol % SiC, and (b) shows a metal composite powder containing 30 vol % SiC.

7. Surface Analysis of Metal Composite Powder According to SiC Size

Figure 15:
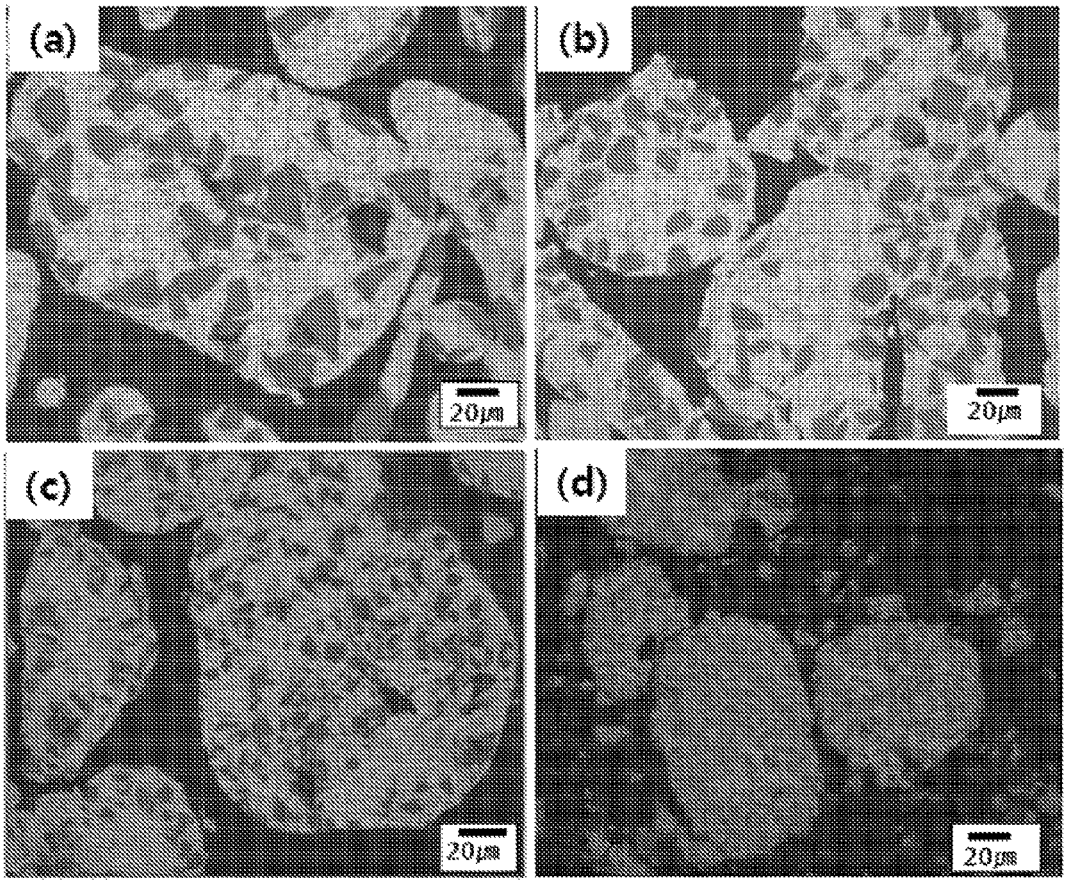
FIG. 15 is optical micrographs showing surfaces of metal composite powders having different SiC sizes in an Al matrix prepared according to the method of the present invention ((a): 17 μm, (b): 12 μm, (c): 6.5 μm, (d): 1 μm)

Optical microscope (OM) analysis was performed in order to investigate the surfaces of the metal composite powders prepared with different SiC sizes in an Al matrix by using the preparation method according to the present invention and the results thereof are shown in FIG. 15.

FIG. 15(*a*) shows a metal composite powder containing 17 μm sized SiC, (b) shows a metal composite powder containing 12 μm sized SiC, (c) shows a metal composite powder containing 6.5 μm sized SiC. Also, (d) shows a metal composite powder containing about 1 μm sized SiC which was obtained by heating the metal composite powder containing 12 μm sized SiC at 750° C. and holding for 30 minutes, and then cooling.

8. Surface Analysis of Metal Composite Powder According to Al Alloy Addition

Figure 16:
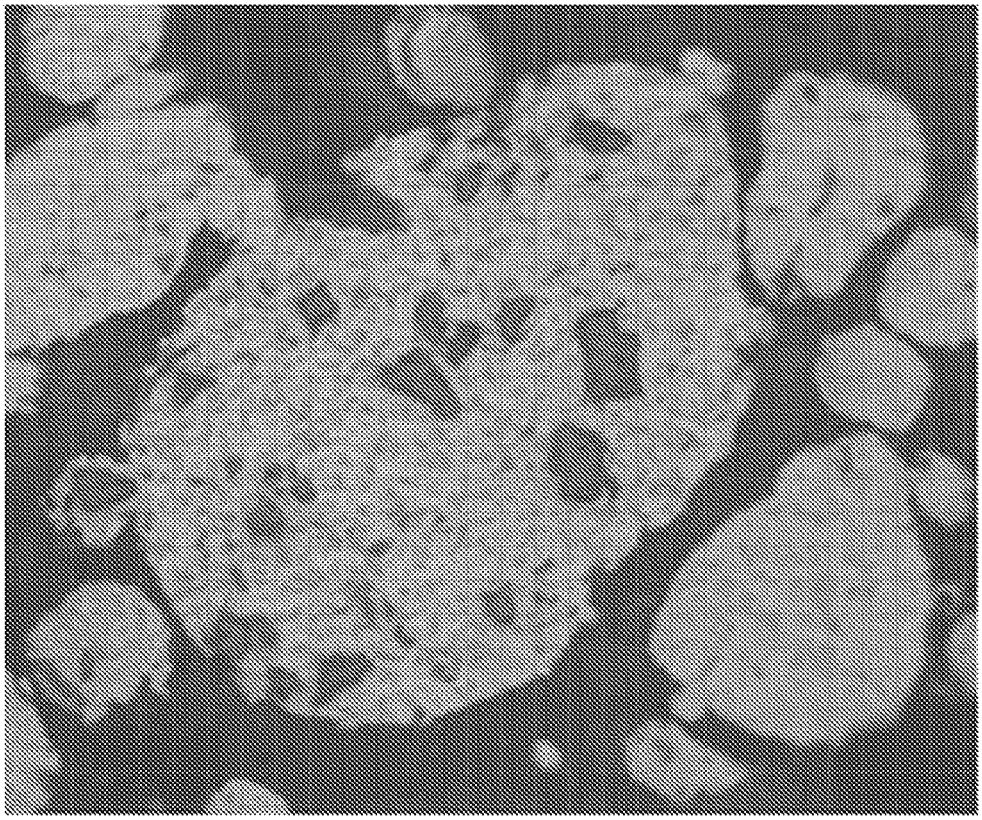
FIG. 16 is optical micrographs showing surfaces of metal composite powders prepared according to Examples 2 and 3 of the present invention ((a): Example 3, (b): Example 2)
Figure 16:
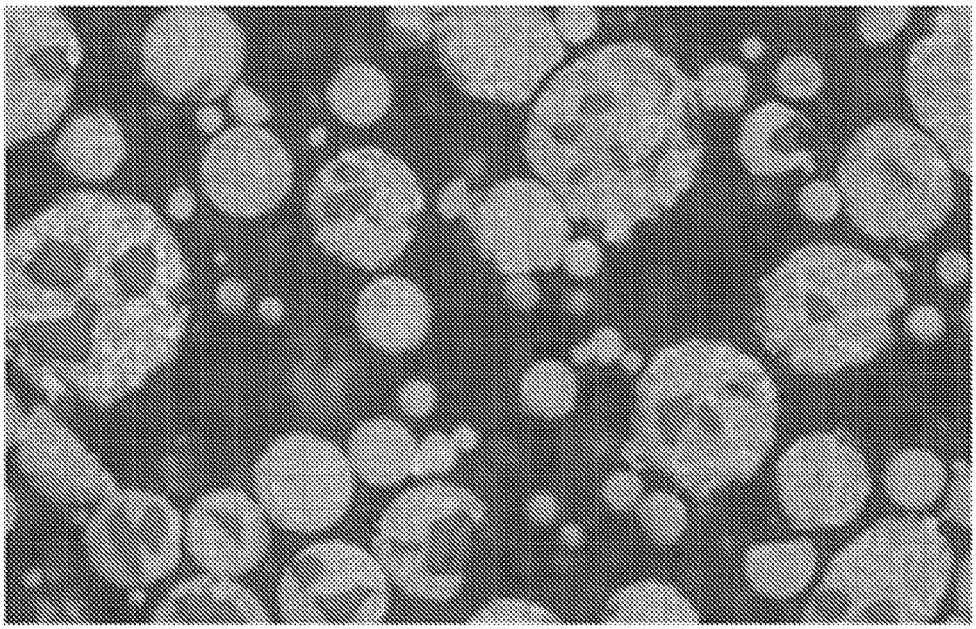

Optical microscope analysis was performed in order to investigate the surfaces of the metal composite powders prepared in Examples 2 and 3 according to the present invention and the results thereof are shown in FIG. 16.

FIG. 16(*a*) shows a metal composite powder of Example 3 prepared by including an Al ingot in an Al—Si—SiC based ingot, and (b) shows a metal composite powder of Example 2 prepared by including an Al—Si—Cu—Fe—Mg—Mn ingot in an Al—Si—SiC based ingot.

EXPERIMENTAL EXAMPLE 1

Surface Analysis of Metal Composite Powder According to Melt Temperature

Figure 17:
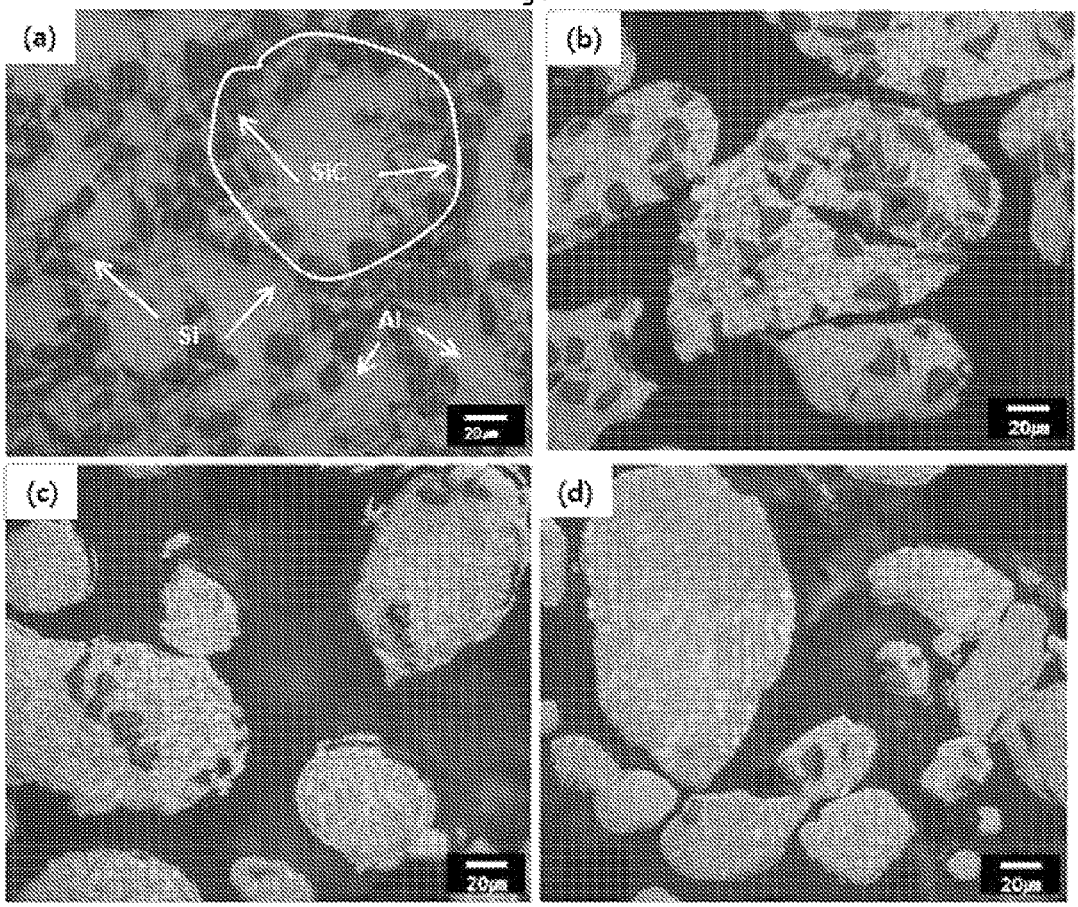
FIG. 17 is optical micrographs showing surfaces of metal composite powders according to melt temperatures ((a): cast Al—Si—SiC based alloy, (b): Example 1, (c) Comparative Example 1, (d) Comparative Example 2)

Optical microscope analysis was performed in order to investigate the surfaces of the metal composite powders according to melt temperatures and the results thereof are shown in FIG. 17.

FIG. 17(*a*) shows a cast Al—Si—SiC based alloy, FIG. 17(*b*) shows a metal composite powder of Example 1, and FIGS. 17(*c*) and (*d*) show metal composite powders of Comparative Examples 1 and 2, respectively. As shown in FIG. 17, it may be understood that 750° C., which was the melt temperature of Example 1, was an appropriate temperature for preparing a metal composite powder, and SiC was segregated and decomposed in Comparative Examples 1 and 2 because viscosities of the melts decreased and the melting times increased.

EXPERIMENTAL EXAMPLE 2

Figure 18:
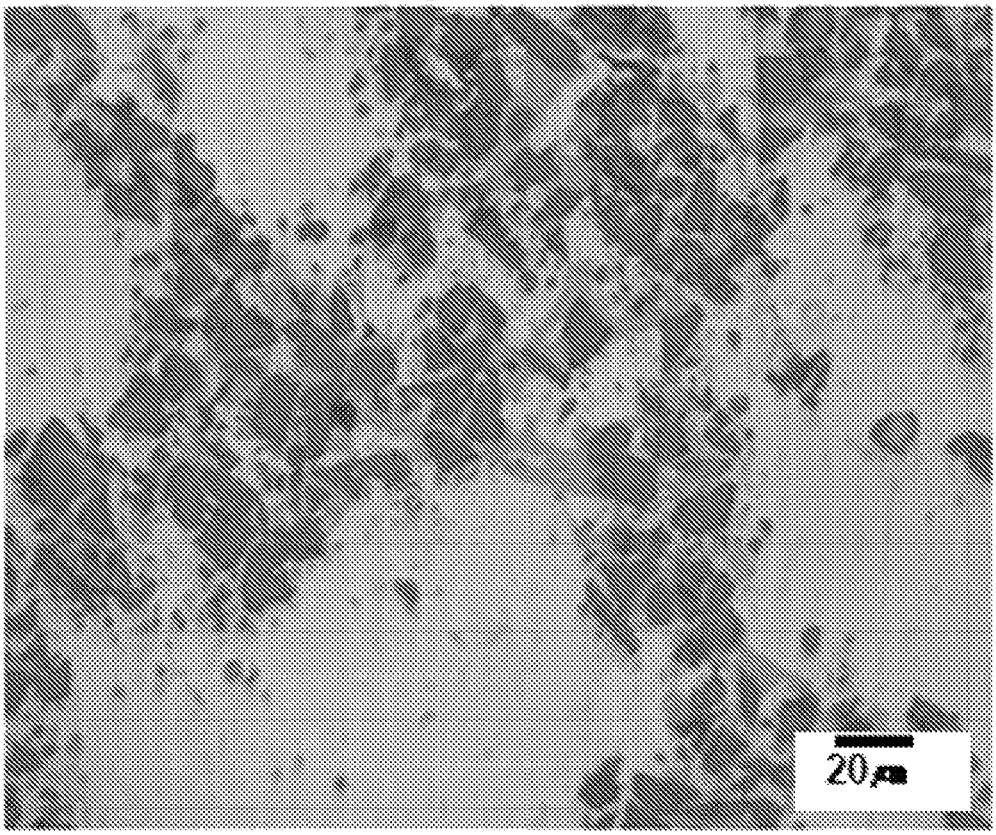
FIG. 18 is optical micrographs showing surfaces of a powder sample prepared by using gas spraying and a melt-cast sample ((a): Comparative Example 3, (b): Example 1)
Figure 18:
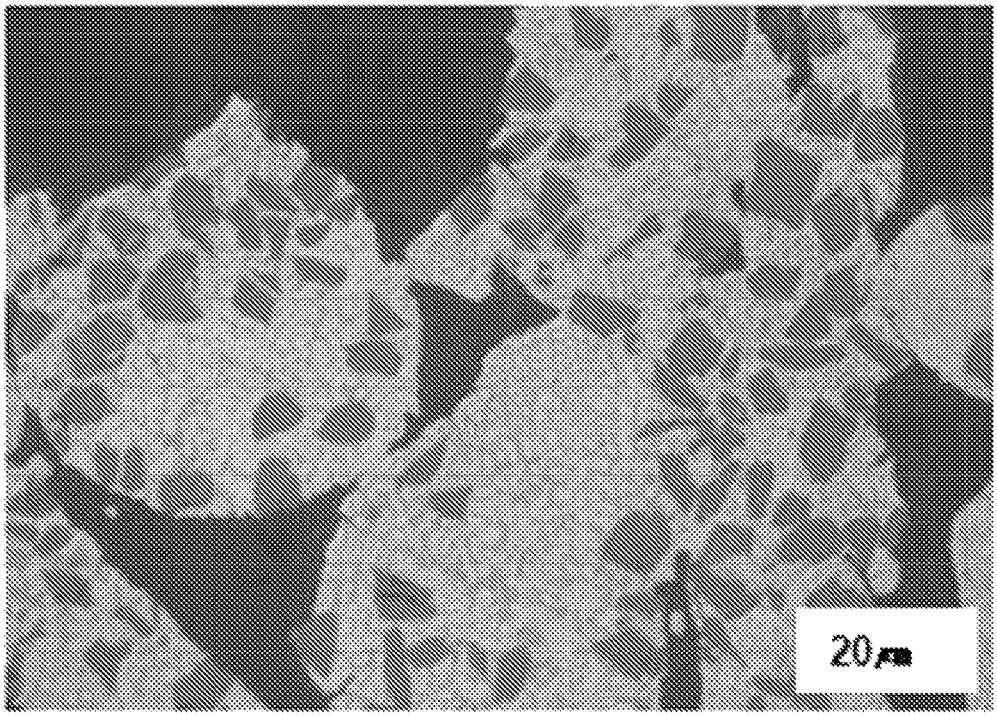

Surface Analyses of Powder Sample Prepared by Gas Spraying and Melt-Cast Sample Optical microscope analysis was performed in order to investigate the surfaces of a powder sample prepared by gas spraying and a melt-cast sample, and the results thereof are shown in FIG. 18.

As shown in FIG. 18, it may be understood that Example 1 (FIG. 18(*b*)) according to the present invention had improved wettability of Al—SiC in comparison to Example 3 (FIG. 18(*a*)), and SiC was uniformly and intra-granularly distributed.

EXPERIMENTAL EXAMPLE 3

Tensile Strength Analyses of Extruded Sample Prepared with Metal Composite Powder According to Heat Treatment Methods An extruded sample was prepared with the metal composite powder of Example 1 prepared by the preparation method of the present invention and tensile strengths were analyzed according to heat treatment methods. The results thereof are presented in FIG. 19 and Table 1 below.

TABLE 1

| Example | Maximum tensile strength (MPa) | Young's Modulus (MPa) | Elongation (%) |
|---|---|---|---|
| T-6 heat-treated | 382 | 334 | 7 |
| Extruded Sample (as-extruded) | 209 | 133 | 15 |
| Heat treatment (annealed) | 188 | 114 | 18 |
| Cast sample (as-cast) | 310 | 255 | 5 |

An Al—Si—SiC based metal composite powder prepared by the method of Example 1 was subjected to canless extrusion at about 470° C. to prepare an extruded sample, and then the extruded sample was heat treated at 350° C. for 30 minutes in order to remove extrusion stress. Also, in order to improve mechanical properties through precipitation hardening, the extruded sample was heat treated at 540° C. for 8 hours and then water cooled. Subsequently, a T-6 heat treatment was performed by heat treating at 170° C. for 4 hours and cooling. The data for the cast sample were quoted from the experimental results of MC-21 Inc. obtained after a T-6 heat treatment.

Figure 19:
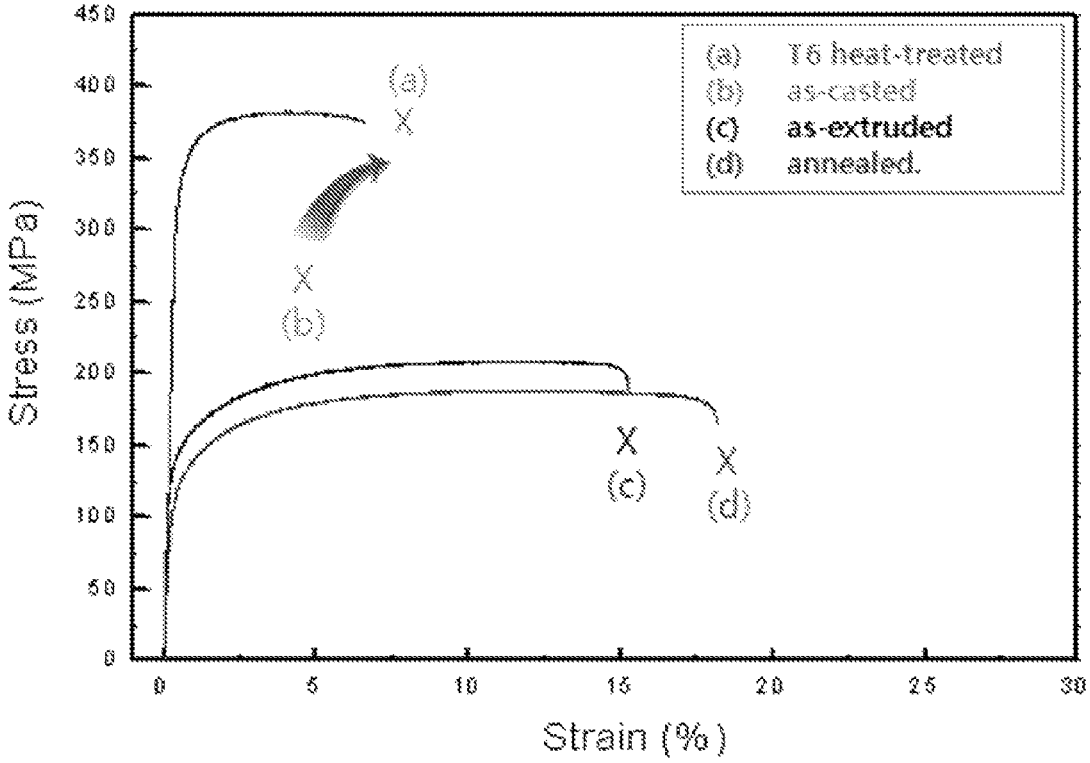
FIG. 19 is a graph showing tensile strengths of an extruded sample, which is formed of the metal composite powder of Example 1 prepared according to the present invention, according to heat treatment methods.

As shown in FIG. 19 and Table 1, with respect to the extruded sample prepared by performing a T-6 heat treatment on the metal composite powder according to the preparation method of the present invention, it may be understood that maximum tensile strength, Young's modulus, and elongation were respectively improved about 23%, about 31%, and 40% in comparison to the as-cast sample.

EXPERIMENTAL EXAMPLE 4

Wear resistance Analyses of Samples According to Preparation methods

Figure 20:
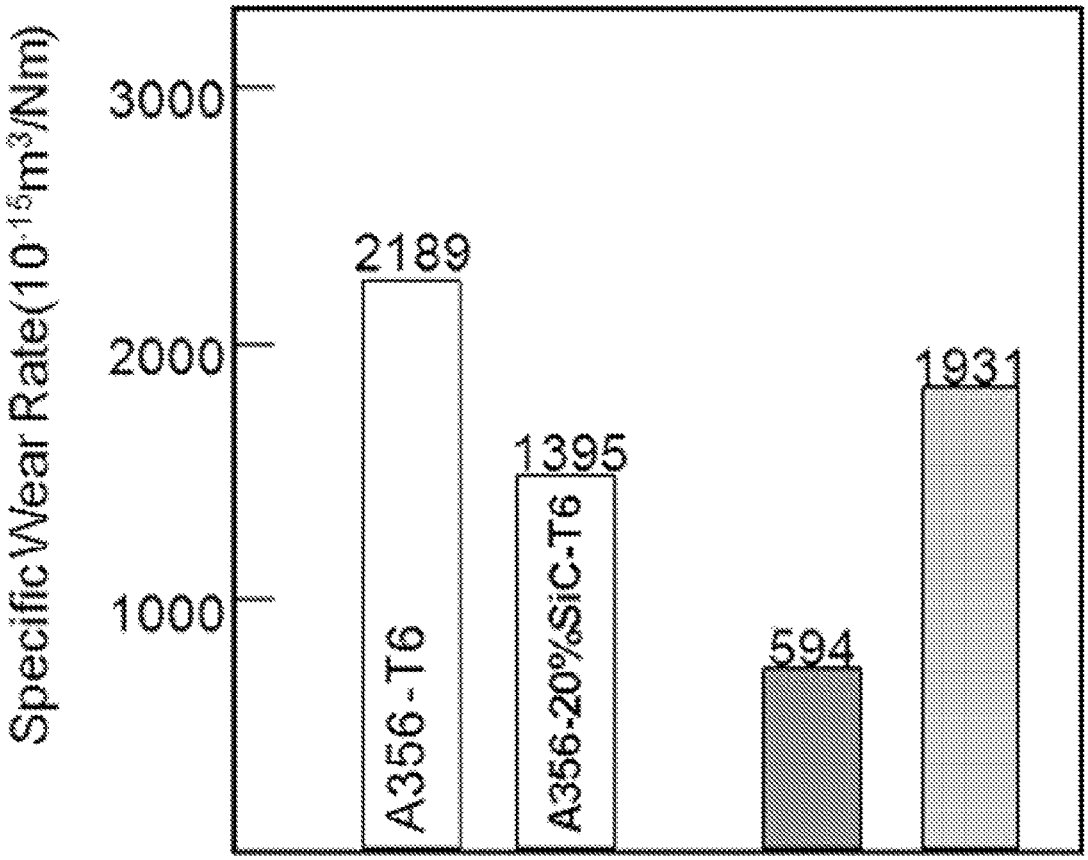
FIG. 20 is a graph showing wear resistances of samples according to preparation methods.

Wear resistances of samples according to preparation methods were analyzed and the results thereof are presented in FIG. 20.

As shown in FIG. 20, a specific wear rate was $2189\times10^{-15}$ $m^3/Nm$ when a sample prepared by squeeze casting at a pressure of 50 MPa was subjected to a T-6 heat treatment, a specific wear rate was $1395\times10^{-15}$ $m^3/Nm$ when a sample containing 20 vol % SiC prepared by squeeze casting was subjected to a T-6 heat treatment, a specific wear rate was $594\times10^{-15}$ $m^3/Nm$ with respect to a sample prepared by extruding the metal composite powder of Example 1 according to the present invention, and a specific wear rate was $1931\times10^{-15}$ $m^3/Nm$ when the sample prepared by extruding the metal composite powder of Example 1 according to the present invention was heat treated. Therefore, it may be understood that the sample prepared by extruding the metal composite powder of Example 1 according to the present invention has a greatly improved specific wear rate.

According to the present invention, a metal composite powder for powder metallurgy containing a property-controlled reinforcing phase may be mass produced.

Products having improved mechanical properties may be produced by performing a powder metallurgical process using the metal composite powder thus produced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of preparing a metal composite powder by gas spraying, the method comprising:

preparing a melt by melting an aluminum material, wherein the aluminum material is selected from the group consisting an aluminum ingot and an aluminum-silicon (Al—Si) based alloy, at a melt temperature to produce a melt;

adding a SiC reinforcing phase material to the melt to form a reinforced metal melt;

increasing the melt temperature to a temperature above 700° C. and below 800° C. within 5 minutes to 30 minutes.

wherein no additional heat treatments exceed 800° C.; and atomizing the reinforcing metal melt with a gas to prepare a metal composite powder.

2. The method of claim 1, wherein the method further comprises adding a metal selected from the group consisting of a metal ingot and an alloy ingot, to the melt, wherein the metal ingot comprises a metal selected from the group consisting of aluminum (Al), tin (Sn), and copper (Cu), and wherein the alloy ingot comprises a metal alloy selected from the group consisting of an aluminum-silicon (Al—Si) alloy, an aluminum-copper (Al—Cu) alloy, and an aluminum-iron (Al—Fe) alloy.

3. The method of claim 1, wherein the metal composite powder has a size range of 10 μm to 5000 μm.

4. The method of claim 1, wherein the reinforcing phase material in the metal composite powder is in a range of 0.001 μm to 50 μm.

5. The method of claim 1, wherein the reinforcing phase material is added at a temperature in which a crystal structure is generated in the metal composite powder.

6. The method of claim 1, wherein the reinforcing metal melt has a range of 0.1 vol % to 70 vol % of the reinforcing phase material.

7. The method of claim 1, wherein the gas is a mixed gas in which a volume fraction ratio between nitrogen and oxygen is in a range of 7:3 to 9:1.

8. The method of claim 1, wherein the atomizing is performed in a pressure range of 5 bars to 100 bars.

9. The method of claim 2, wherein the metal is a metal ingot and wherein the metal ingot is an aluminum-silicon (Al—Si) based alloy, and wherein the reinforcing phase material is aluminum-silicon (Al—Si).

* * * * *